US010562549B2

(12) United States Patent
Yu et al.

(10) Patent No.: US 10,562,549 B2
(45) Date of Patent: Feb. 18, 2020

(54) TRAIN CONNECTOR AND INSERTED CONNECTION MEMBER THEREOF

(71) Applicant: CRRC QINGDAO SIFANG CO., LTD., Qingdao, Shandong (CN)

(72) Inventors: Weikai Yu, Shandong (CN); Xiaojun Deng, Shandong (CN); Shaoqing Liu, Shandong (CN); Wei Kang, Shandong (CN); Shi Xiao, Shandong (CN); Jin Yu, Shandong (CN); Shiping Gao, Shandong (CN); Guimei Deng, Shandong (CN); Yan Wang, Shandong (CN); Bo Zhang, Shandong (CN); Junchao Zhou, Shandong (CN)

(73) Assignee: CRRC QINGDAO SIFANG CO., LTD., Qingdao, Shandong (CN)

( * ) Notice: Subject to any disclaimer, the term of this patent is extended or adjusted under 35 U.S.C. 154(b) by 518 days.

(21) Appl. No.: 15/436,040

(22) Filed: Feb. 17, 2017

(65) Prior Publication Data

US 2017/0369082 A1 Dec. 28, 2017

(30) Foreign Application Priority Data

Jun. 24, 2016 (CN) ..... 2016 1 0481403

(51) Int. Cl.
*B61G 5/10* (2006.01)

(52) U.S. Cl.
CPC ..... *B61G 5/10* (2013.01)

(58) Field of Classification Search
CPC ..... B61G 5/10; H04B 5/0031; H01Q 1/32
See application file for complete search history.

(56) References Cited

U.S. PATENT DOCUMENTS 1,699,787 A * 1/1929 Gray ..... B61G 5/10 307/41
2,132,977 A * 10/1938 Stevens ..... B61G 5/10 213/212
2,142,176 A * 1/1939 Cameron ..... B61G 5/10 439/289
5,960,540 A * 10/1999 Pentz ..... H01R 13/025 29/33 M (Continued)

FOREIGN PATENT DOCUMENTS

CN 101702498 A * 5/2010 ..... H02G 1/04

*Primary Examiner* — Scott A Browne
(74) *Attorney, Agent, or Firm* — Yue (Robert) Xu; Apex Attorneys at Law, LLP

(57) ABSTRACT

An inserted connection member for a train connector includes an insertion needle, an insulator, a disconnection preventing pad and an extrusion block. The insulator is sequentially provided with a positioning hole and an inserted connection hole in an axial direction. The insertion needle includes a line connecting segment, a positioning segment and an inserted connection segment which are connected sequentially, the line connecting segment and the positioning segment are arranged in the positioning hole. The disconnection preventing pad and the extrusion block are both sleeved on the line connecting segment, and the disconnection preventing pad includes a pad body and a boss arranged on the pad body. Thus, the insertion needle is ensured to maintain a stable contact even when the train is running at a high speed, and a disconnection preventing effect of the insertion needle is achieved.

19 Claims, 4 Drawing Sheets

(56) References Cited

U.S. PATENT DOCUMENTS

| | | | | |
|---|---|---|---|---|
| 8,985,356 | B2 * | 3/2015 | Krause | B61G 5/10 213/75 R |
| 9,616,904 | B2 * | 4/2017 | Lv | B61G 7/08 |
| 2010/0326942 | A1 * | 12/2010 | Dahlstrom | B61G 5/10 213/1.3 |

* cited by examiner

TRAIN CONNECTOR AND INSERTED CONNECTION MEMBER THEREOF

CROSS REFERENCE OF RELATED APPLICATION

The present application claims the priority to Chinese Patent Application No. 201610481403.1, titled "TRAIN CONNECTOR AND INSERTED CONNECTION MEMBER THEREOF", filed on Jun. 24, 2016, with the State Intellectual Property Office of the People's Republic of China, the content of which is incorporated herein by reference in its entirety.

FIELD

This application relates to the technical field of train communication, and particularly relates to a train connector and an inserted connection member thereof.

BACKGROUND

With the development of railroad cars, new-type and high speed motor train units are emerged continuously, which imposes stricter requirements on installation and connectors of the motor train units, the connectors must ensure needles against being disconnected during high speed running of the vehicle and a reliable contact of the needles.

The conventional self-locking type and interlocking type insertion needle disconnection prevention methods fail to address the issue of needle disconnection when the motor train units are in a high speed running condition and in complex road conditions. Furthermore, in the self-locking and interlocking disconnection prevention methods, when the needle is withdrawn, a special tool is required to separate a socket from a plug, which tends to cause a self-locking spring or an interlocking spring to be damaged and lose the elasticity, and therefore cannot be used repeatedly. As shown in FIG. 1 which shows a conventional train connector in a state of disconnection, the connector includes a socket 1 and a plug 2. The socket 1 includes an insertion needle 101 and an insulator 102. The insertion needle 101 is fixed by a retaining slot 103 and a retaining spring arranged in the retaining slot 103. The plug 2 includes an insertion needle 201 and an insulator 202. The insertion needle 201 is fixed by a retaining slot 203 and a retaining spring 204 arranged in the retaining slot 203. In use, the insertion needle 201 of the plug 2 is inserted into the insertion needle 101 of the socket 1 to achieve connection between the plug and the socket. Such a connector is likely to generate needle disconnection during use due to the high speed running of the train, thus may adversely affect the use of the connector.

SUMMARY

(1) Technical Issues to be Addressed

The technical issues to be addressed by the present application are that the conventional train connector is apt to disconnect the needles and is apt to be damaged during needle withdrawing.

(2) Technical Solution

For addressing the above technical issues, an inserted connection member for a train connector is provided according to the present application, which includes an insertion needle, an insulator, a disconnection preventing pad and an extrusion block. The insulator is sequentially provided with a positioning hole and an inserted connection hole in an axial direction, the positioning hole has a diameter larger than a diameter of the inserted connection hole. The insertion needle includes a line connecting segment, a positioning segment and an inserted connection segment which are connected sequentially, the line connecting segment and the positioning segment are arranged in the positioning hole, and the positioning segment has a diameter larger than a diameter of the inserted connection hole. The disconnection preventing pad and the extrusion block are both sleeved on the line connecting segment, the disconnection preventing pad includes a pad body and a boss arranged on the pad body, the pad body is arranged between the extrusion block and the insulator, and the boss is arranged in the positioning hole with an end surface of the boss abutting against the positioning segment.

Specifically, the positioning hole includes a tapered segment and a constant diameter segment, the constant diameter segment is arranged between the tapered segment and the inserted connection hole, and the positioning segment is in cooperation with the constant diameter segment, and the boss is in cooperation with the tapered segment.

Specifically, the diameters of two ends of the boss are respectively $D_1$ and $D_2$, and the diameters of two ends of the tapered segment are respectively $D_3$ and $D_4$, the diameter of the constant diameter segment is $D_5$, wherein: $D_3 \leq D_1 < D_4 \leq D_2$, and $D_5 = D_3$.

Specifically, the disconnection preventing pad is provided with a nesting hole extending through the boss and the pad body in an axial direction of the boss, and the nesting hole has a diameter equivalent to the diameter of the line connecting segment.

Specifically, the boss is provided with a notch in communication with the nesting hole, and the notch extends from an end of the boss to another end of the boss.

Specifically, the notch has a width gradually decreased from the end surface of the boss to an end of the boss, which end is connected to the pad body.

Specifically, the width of the notch gradually is decreased in a direction from an outer wall of the boss to a wall of the nesting hole.

Specifically, the boss has a length equivalent to a length of the tapered segment.

Specifically, the disconnection preventing pad is made of an elastic material.

A train connector is further provided according to the present application, which includes the inserted connection member according to any one of the above aspects, a number of the inserted connection member is two, and an inserted connection segment of an insertion needle of one of the inserted connection members extends outwards in an axial direction to form a connecting portion, and an inserted connection segment of an insertion needle of the other one of the inserted connection members is provided, in the axial direction, with a connecting hole in cooperation with the connecting portion.

(3) Beneficial Effects

The above technical solutions of the present application have the following advantages. An inserted connection member of a train connector is provided according to the present application, which includes an insertion needle, an insulator, a disconnection preventing pad and an extrusion block. The insulator is provided sequentially with a positioning hole and an inserted connection hole in an axial direction, the positioning hole has a diameter larger than the diameter of the inserted connection hole; the insertion needle includes a line connecting segment, a positioning segment and an inserted connection segment which are connected sequentially, the line connecting segment and the positioning segment are arranged in the positioning hole, and the positioning segment has a diameter larger than the diameter of the inserted connection hole; the disconnection preventing pad and the extrusion block are both sleeved on the line connecting segment, the disconnection preventing pad includes a pad body and a boss arranged on the pad body, the pad body is arranged between the extrusion block and the insulator, and the boss is arranged in the positioning hole with an end surface of the boss abutting against the positioning segment. When the insertion needle is required to be fixed, the extrusion block extrudes the disconnection preventing pad, and the disconnection preventing pad is in contact with the positioning segment of the insertion needle under the action of the extrusion force of the extrusion block, thus extruding the positioning segment to a joint position between the positioning hole and the inserted connection hole, so that the insertion needle is fixed. The disconnection preventing pad can provide a continuous pressure to the insertion needle, so that it is ensured that the insertion needle can maintain a stable contact even when the train runs at a high speed, thereby achieving the disconnection preventing effect of the insertion needle. In addition, with the disconnection preventing structure, the operation is also convenient when the insertion needle is withdrawn, the insertion needle can just be drawn from the insulator simply by loosening the extrusion block, thus significantly improving the efficiency in connecting and disconnecting the connector.

In addition to the technical issues to be addressed by the present application, the technical features constituting the technical solution and the advantages brought by the technical features of the technical solution described above, other technical features of the present application and the advantages brought by the technical features are further described with reference to drawings.

REFERENCE NUMERALS IN THE DRAWINGS

| | | | |
|---|---|---|---|
| 1 | socket, | 2 | plug, |
| 3 | insulator, | 4 | insertion needle, |
| 5 | disconnection preventing pad, | 6 | extrusion block, |
| 7 | insertion needle, | 101 | insertion needle, |
| 102 | insulator, | 103 | retaining slot, |
| 104 | retaining spring, | 201 | insertion needle, |
| 202 | insulator, | 203 | retaining slot, |
| 204 | retaining spring, | 301 | tapered segment, |
| 302 | constant diameter segment, | 303 | inserted connection hole, |
| 401 | line connecting segment, | 402 | positioning segment, |
| 403 | inserted connection segment, | 4031 | connecting hole, |
| 501 | pad body, | 502 | boss, |
| 503 | notch, | 504 | nesting hole, |
| 701 | line connecting segment, | 702 | positioning segment, |
| 703 | inserted connection segment, and | 7031 | connecting portion. |

DETAILED DESCRIPTION

For making the object, the technical solutions and the advantages of the embodiments of the present application more clear, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by those skilled in the art without any creative efforts, fall into the scope of the present application.

In the description of the present application, it is to be noted that, except for being explicitly stipulated and defined otherwise, the terms "mount", "joined together", "connect" should be construed broadly, for example, it may be a fixed connection, and may also be a detachable connection, or an integral connection; it may be a mechanical connection, and may also be an electrical connection; it may be a direct connection, and may also be an indirect connection via an intermediate medium, it may be communication of internal portions of two elements. For those skilled in the art, the specific meanings of the above terms in the present application can be understood according to specific situations.

Furthermore, in the description of the present application, except for being noted otherwise, the terms "multiple", "multiple pieces", "multiple sets" mean two or more than two, and the terms "several", "several pieces" and "several sets" mean one or more than one.

Figure 1:
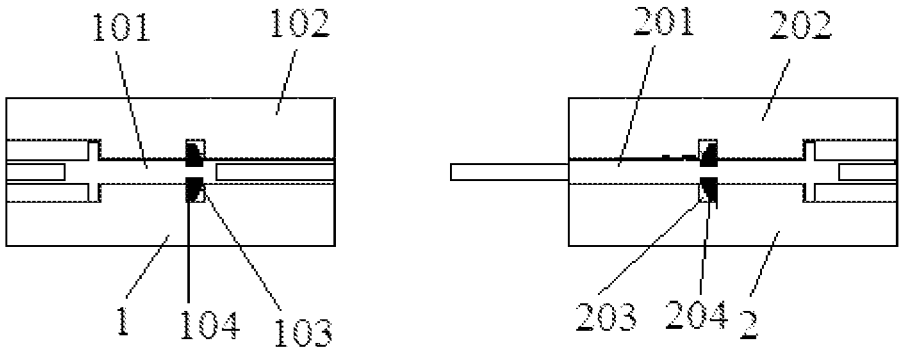
Fig. 1 Prior Art
FIG. 1 is a schematic view showing the structure of a conventional connector.
Figure 2:
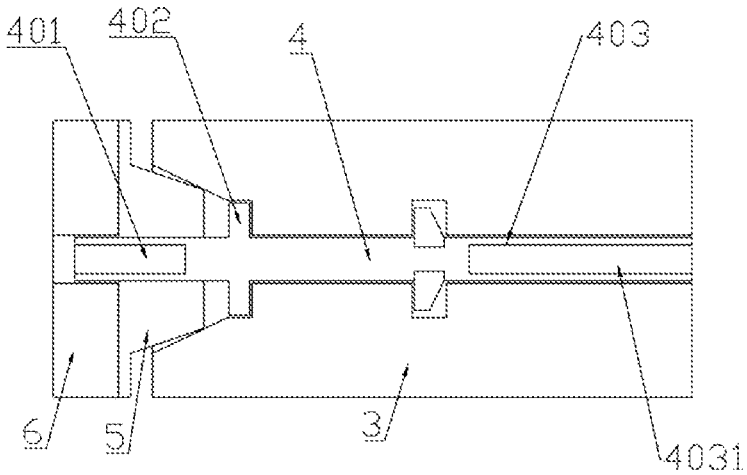
FIG. 2 is a schematic view showing the structure of an inserted connection member of a train connector according to an embodiment of the present application in a state of not being pressed in place.
Figure 3:
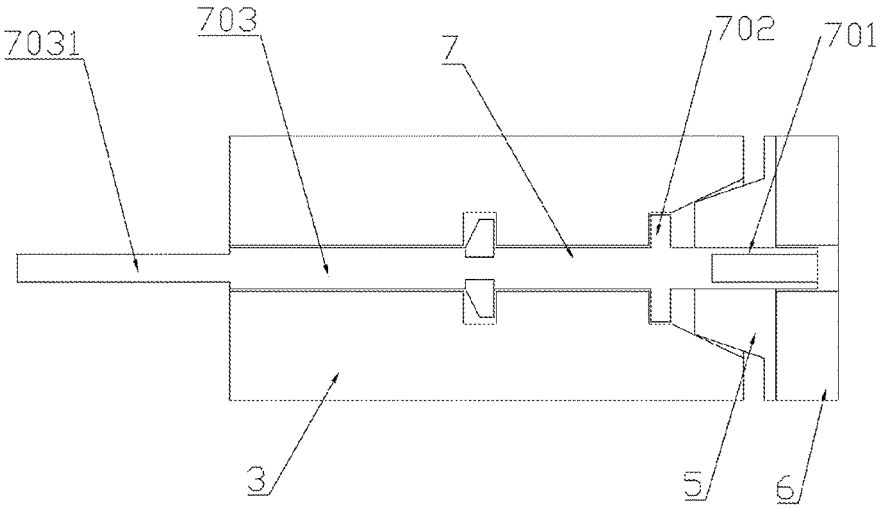
FIG. 3 is a schematic view showing the structure of another inserted connection member of a train connector according to an embodiment of the present application in a state of not being pressed in place.
Figure 4:
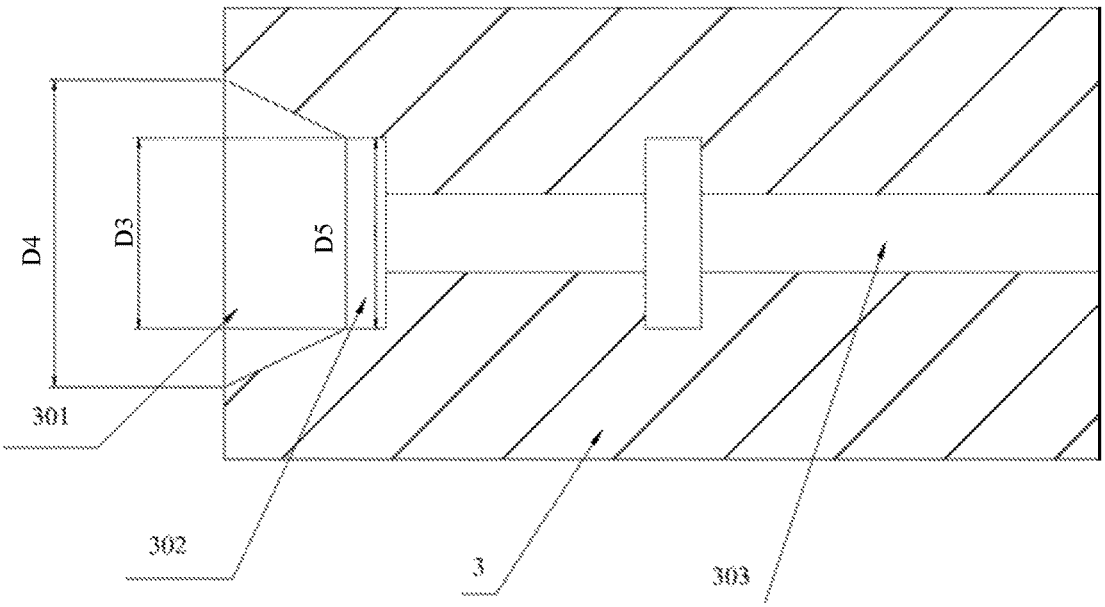
FIG. 4 is a schematic view showing the structure of an insulator according to an embodiment of the present application.
Figure 5:
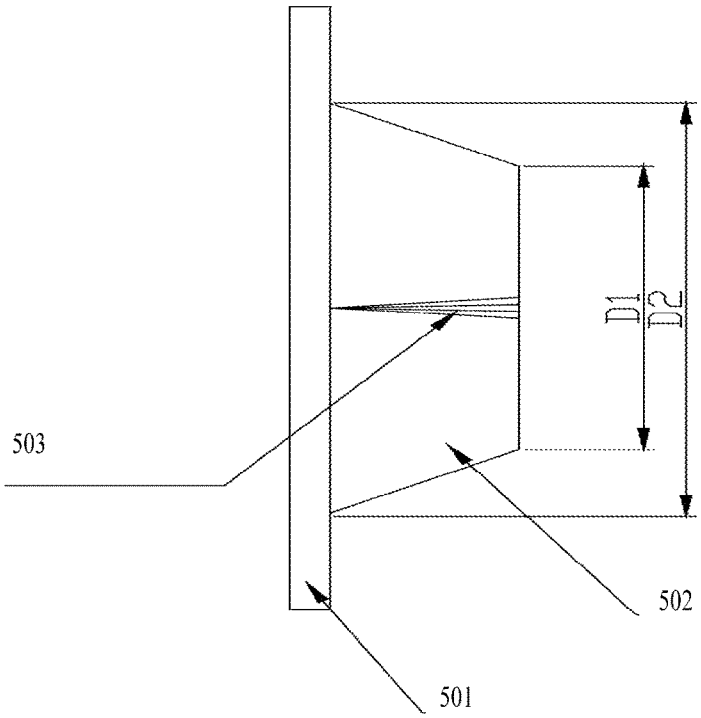
FIG. 5 is a schematic view showing the structure of a disconnection preventing pad according to an embodiment of the present application.
Figure 6:
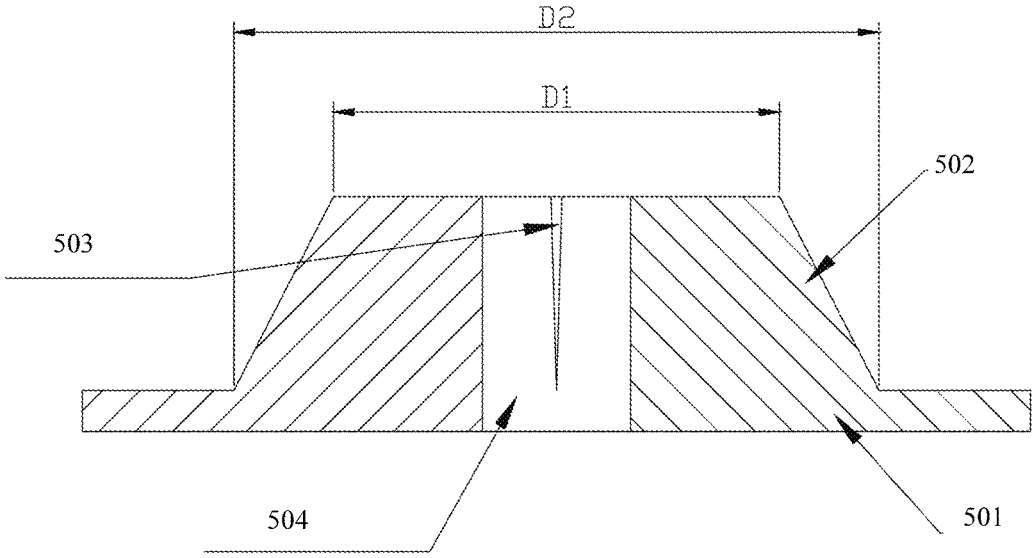
FIG. 6 is a sectional view of the disconnection preventing pad according to an embodiment of the present application.

As shown in FIGS. 2 to 6, an inserted connection member for a train connector according to an embodiment of the present application includes an insertion needle, an insulator 3, a disconnection preventing pad 5 and an extrusion block 6. The insulator 3 is sequentially provided with a positioning hole and an inserted connection hole 303 in an axial direction. The positioning hole has a diameter larger than a diameter of the inserted connection hole 303, that is, a stepped surface is formed between the positioning hole and the inserted connection hole 303. The insertion needle includes a line connecting segment, a positioning segment and an inserted connection segment connected sequentially. The inserted connection segment is arranged in the inserted connection hole 303. The insertion needle generally includes two types, and the inserted connection member may be divided into two kinds, i.e., a socket and a plug according to different insertion needles, and commonly the two types of insertion needles should be used matching with each other. As shown in FIG. 2, an insertion needle 4 includes a line connecting segment 401, a positioning segment 402, and an inserted connection segment 403 which are connected sequentially. The inserted connection segment 403 is provided with a connecting hole 4031. As shown in FIG. 3, another insertion needle 7 includes a line connecting segment 701, a positioning segment 702 and an inserted connection segment 703 which are sequentially connected. The inserted connection segment 703 extends outwards in an axial direction to form a connecting portion 7031. In use, the connecting portion 7031 is inserted into the connecting hole 4031 to achieve connection between the two inserted connection members, and further achieve connection of lines. The insertion needles in the two inserted connection members achieve disconnection prevention in the same manner, and the manner is described taking one of the two inserted connection members as an example. As shown in FIG. 2, the line connecting segment 401 and the positioning segment 402 are arranged in the positioning hole, and the positioning segment 402 has a diameter larger than a diameter of the inserted connection hole 303, an end surface of the positioning segment 402 abuts against the stepped surface between the positioning hole and the inserted connection hole 303. The disconnection preventing pad 5 and the extrusion block 6 are both sleeved on the line connecting segment 401. As shown in FIGS. 5 and 6, the disconnection preventing pad 5 includes a pad body 501 and a boss 502 on the pad body 501. The disconnection preventing pad 501 is provided with a nesting hole 504, the nesting hole 504 extends through the boss 502 and the pad body 501 in an axial direction of the boss 502, and the nesting hole 504 has a diameter equivalent to a diameter of the line connecting segment 401. The pad body 501 is arranged between the extrusion block 6 and the insulator 3, and the boss 502 is arranged in the positioning hole with an end surface of the boss 502 abutting against the positioning segment 402. When it is required to fix the insertion needle 4, the extrusion block 6 extrudes the disconnection preventing pad 5, and the disconnection preventing pad 5 is in contact with the positioning segment 402 of the insertion needle 4 under the action of an extrusion force of the extrusion block 6, in order to extrude the positioning segment 402 to a joint position between the positioning hole and the inserted connection hole 303, thus fixing the insertion needle. The disconnection preventing pad 5 can provide a continuous pressure for the insertion needle 4, to ensure that the insertion needle 4 can maintain a stable contact even when the train runs at a high speed, thus achieving the disconnection preventing effect of the insertion needle 4. Further, needle withdrawing of the disconnection preventing structure can also be operated conveniently, simply by loosening the extrusion block 6, the insertion needle 4 may just be drawn from the insulator 3 rapidly, thus significantly improving the efficiency in connecting and disconnecting the connector.

Further, the positioning hole includes a tapered segment 301 and a constant diameter segment 302. The constant diameter segment 302 is arranged between the tapered segment 301 and the inserted connection hole 303. An end, connected to the constant diameter segment 302, of the tapered segment 301 has a diameter smaller than a diameter of another end of the tapered segment 301. The positioning segment 402 fits the constant diameter segment 302, and the boss 502 fits the tapered segment 301. The boss 502 is taper-shaped, and the boss 502 has a size matching with a size of the tapered segment 301. In this embodiment, the boss 502 has a length equivalent to a length of the tapered segment 301, thus, under the action of the extrusion force, the boss 502 may be exactly received in the tapered segment 301. Designed in the tapered shape, the boss 502 can provide an axial extrusion force to the insertion needle 4 in the process of extruding the insertion needle 4, thus further intensifying the disconnection preventing effect of the insertion needle 4, and ensuring that the connector can be stably connected even when the train runs at a high speed.

Further, the diameters of two ends of the boss 502 are respectively $D_1$ and $D_2$, and the diameters of two ends of the tapered segment 302 are respectively $D_3$ and $D_4$, the diameter of the constant diameter segment 302 is $D_5$, and these diameters satisfy the relationship: $D_3 \leq D_1 < D_4 \leq D_2$, and $D_5 = D_3$. When not being extruded, the boss 502 is not in contact with the positioning segment 402, and when the extrusion block 6 extrudes the disconnection preventing pad 5, the boss 502 is in contact with the positioning segment 402 and extrudes the positioning segment 402 to allow the insertion needle 4 to be fixed. The disconnection preventing pad 5 provides an axial extrusion force to the insertion needle 4 while extruding the positioning segment 402, thus allowing the insertion needle 4 to be fixed stably.

Further, the disconnection preventing pad 5 may be made of an elastic material. During being extruded, the disconnection preventing pad 5 is slightly deformed under an extrusion force applied by the extrusion block 6 and an extrusion force applied by a side wall of the tapered segment 301, and is in contact with the positioning segment 402 to extrude the positioning segment 402, thus fixing the insertion needle 4.

Further, the boss 502 is provided with a notch 503 in communication with the nesting hole 504, and the notch 503 extends from an end of the boss 502 to another end of the boss 502. In the case that the disconnection preventing pad 5 is moved due to being subjected to the extrusion force applied by the extrusion block 6, the notch 503 starts to be deformed and contracted under the action of the extrusion force applied by the side wall of the tapered segment 301, thus the boss 502 is in contact with the positioning segment 402 to achieve fixing of the insertion needle 4.

Further, according to the force subjecting characteristics of the disconnection preventing pad 5 when being extruded, the notch 503 has a width gradually decreasing from the end surface of the boss 502 to an end, connected to the pad body 501, of the boss 502, and the width of the notch 503 gradually decreases from an outer wall of the boss 502 to a wall of the nesting hole 504.

In addition, in this embodiment, a retaining slot is further provided in an outer wall of the inserted connection segment 403 of the insertion needle 4, and a diameter of the inserted connection hole 303 at a position corresponding to the retaining slot is larger than a diameter of the inserted connection hole 303 at other positions, and a retaining spring is provided at the position, corresponding to the retaining slot, of the inserted connection hole 303, the retaining spring cooperates with the retaining slot to fix the inserted connection segment 403 of the insertion needle 4 in the connecting hole 303.

Figure 7:
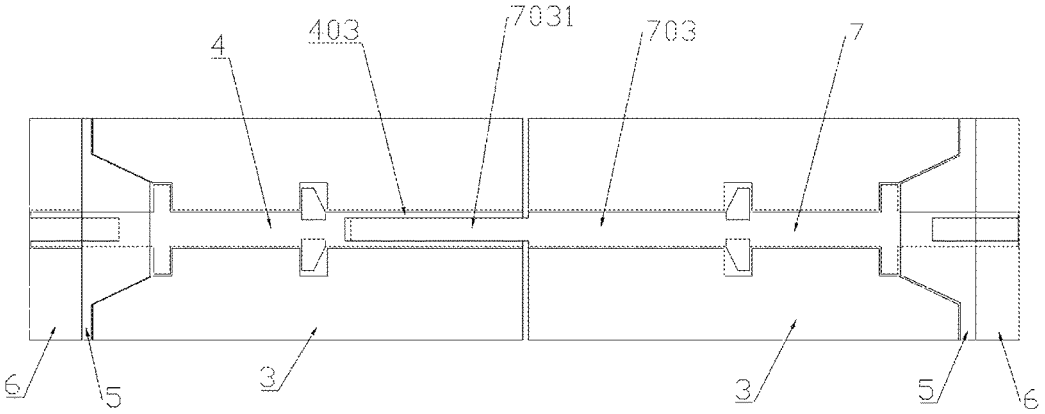
FIG. 7 is a schematic view showing the structure of a train connector according to an embodiment of the present application.

As shown in FIG. 7, a train connector is further provided according to an embodiment of the present application, which includes the two inserted connection members in FIGS. 2 and 3, and an inserted connection segment 703 of an insertion needle 7 of one of the inserted connection members extends outwards in an axial direction to form a connecting portion 7031, and an inserted connection segment 403 of an insertion needle 4 of the other one of the inserted connection members is provided with a connecting hole 4031 matching with the connecting portion in the axial direction. In connection process, it is simply required to employ the extrusion blocks 6 to fix the insertion needle 4 and the insertion needle 7 respectively, and then match the connecting portion 7031 of one insertion needle 7 with the connecting hole 4031 of the other insertion needle 4, the connection of the connector may just be achieved.

In use, the extrusion block may be connected to an outer wall of the line connecting segment by screw threads, thus is easy to tightly press and withdrawn the insertion needles.

In conclusion, in the train connector and the inserted connection member thereof according to an embodiment of the present application, when the disconnection preventing pad is extruded by the extrusion block, the disconnection preventing pad gradually moves along the hole wall of the tapered segment of the positioning hole in a direction for connecting the connector, and the disconnection preventing pad is subjected to the extrusion force applied by the hole wall of the tapered segment simultaneously, and starts to be deformed and contracted, and the notch portion is gradually narrowed, thus tightly pressing the insertion needle. Further, since the insertion needle has been inserted in place, and may not move along with the disconnection preventing pad, the disconnection preventing pad gradually provides an axial stable contact force for the insertion needle with the disconnection preventing pad moving in the connecting direction of the connector. Further, when the boss is not pressed, the distance of the boss from the positioning segment of the insertion needle also limits the axial movement of the insertion needle, thus ensuring that the insertion needle would not be disconnected when being subjected to an intense movement. In this way, the insertion needle can be provided with a continuous extrusion force in a same direction as the connecting direction while being pressed tightly and prevented from being disconnected, to ensure that the socket and the plug of the connector can maintain a stable contact even in a condition that the train runs at a high speed. When the connector needs to withdrawn the insertion needle, the operation is simple, and may not damage the insertion needle and the retaining spring, thus greatly improving the disconnection preventing performance of the insertion needle.

It should be noted finally that, the above embodiments are only intended to illustrate the technical solution of the present application and are not intended to limit the scope of the present application. Although the present application is described in detail in conjunction with the above embodiments, it should be understood that, for those skilled in the art, modifications may be made to the technical solutions of the above embodiments, or equivalent substitutions may be made to part or all of the technical features in the technical solutions; and these modifications or substitutions do not render the essential of these corresponding technical solutions departing from the spirits and scopes of the technical solutions of the various embodiments of the present application.

The invention claimed is:

1. An inserted connection member for a train connector, comprising:

an insertion needle, an insulator, a disconnection preventing pad, and an extrusion block, wherein:

the insulator is sequentially provided with a positioning hole and an inserted connection hole in an axial direction, the positioning hole has a diameter larger than a diameter of the inserted connection hole;

the insertion needle comprises a line connecting segment, a positioning segment and an inserted connection segment which are connected sequentially, the line connecting segment and the positioning segment are arranged in the positioning hole, and the positioning segment has a diameter larger than the diameter of the inserted connection hole; and the disconnection preventing pad and the extrusion block are both sleeved on the line connecting segment, the disconnection preventing pad comprises a pad body and a boss arranged on the pad body, the pad body is arranged between the extrusion block and the insulator, and the boss is arranged in the positioning hole with an end surface of the boss abutting against the positioning segment, when the insertion needle is required to be fixed, the extrusion block extrudes the disconnection preventing pad, and the disconnection preventing pad is in contact with the positioning segment of the insertion needle under the action of the extrusion force of the extrusion block, thus extruding the positioning segment to a joint position between the positioning hole and the inserted connection hole, and when the insertion needle is withdrawn, the insertion needle is drawn from the insulator simply by loosening the extrusion block.

2. The inserted connection member for the train connector according to claim 1, wherein the positioning hole comprises a tapered segment and a constant diameter segment, the constant diameter segment is arranged between the tapered segment and the inserted connection hole, and the positioning segment is in cooperation with the constant diameter segment, and the boss is in cooperation with the tapered segment.

3. The inserted connection member for the train connector according to claim 2, wherein diameters of two ends of the boss are respectively $D_1$ and $D_2$, and diameters of two ends of the tapered segment are respectively $D_3$ and $D_4$, a diameter of the constant diameter segment is $D_5$, wherein: $D_3 \leq D_1 < D_4 \leq D_2$, and $D_5 = D_3$.

4. The inserted connection member for the train connector according to claim 3, wherein the disconnection preventing pad is provided with a nesting hole extending through the boss and the pad body in an axial direction of the boss, and the nesting hole has a diameter equivalent to a diameter of the line connecting segment.

5. The inserted connection member for the train connector according to claim 4, wherein the boss is provided with a notch in communication with the nesting hole, and the notch extends from one end of the boss to another end of the boss.

6. The inserted connection member for the train connector according to claim 5, wherein the notch has a width gradually decreased from an end surface of the boss to an end of the boss, which end is connected to the pad body.

7. The inserted connection member for the train connector according to claim 6, wherein the width of the notch is gradually decreased in a direction from an outer wall of the boss to a wall of the nesting hole.

8. The inserted connection member for the train connector according to claim 1, wherein the disconnection preventing pad is made of an elastic material.

9. The inserted connection member for the train connector according to claim 2, wherein the boss has a length equivalent to a length of the tapered segment.

10. The inserted connection member for the train connector according to claim 3, wherein the boss has a length equivalent to a length of the tapered segment.

11. The inserted connection member for the train connector according to claim 4, wherein the boss has a length equivalent to a length of the tapered segment.

12. The inserted connection member for the train connector according to claim 5, wherein the boss has a length equivalent to a length of the tapered segment.

13. The inserted connection member for the train connector according to claim 6, wherein the boss has a length equivalent to a length of the tapered segment.

14. The inserted connection member for the train connector according to claim 7, wherein the boss has a length equivalent to a length of the tapered segment.

15. A train connector, comprising the inserted connection member according to claim 1, wherein a number of the inserted connection member is two, and an inserted connection segment of an insertion needle of one of the inserted connection members extends outwards in an axial direction to form a connecting portion, and an inserted connection segment of an insertion needle of the other one of the inserted connection members is provided, in the axial direction, with a connecting hole in cooperation with the connecting portion.

16. A train connector, comprising the inserted connection member according to claim 2, wherein a number of the inserted connection member is two, and an inserted connection segment of an insertion needle of one of the inserted connection members extends outwards in an axial direction to form a connecting portion, and an inserted connection segment of an insertion needle of the other one of the inserted connection members is provided, in the axial direction, with a connecting hole in cooperation with the connecting portion.

17. A train connector, comprising the inserted connection member according to claim 3, wherein a number of the inserted connection member is two, and an inserted connection segment of an insertion needle of one of the inserted connection members extends outwards in an axial direction to form a connecting portion, and an inserted connection segment of an insertion needle of the other one of the inserted connection members is provided, in the axial direction, with a connecting hole in cooperation with the connecting portion.

18. A train connector, comprising the inserted connection member according to claim 4, wherein a number of the inserted connection member is two, and an inserted connection segment of an insertion needle of one of the inserted connection members extends outwards in an axial direction to form a connecting portion, and an inserted connection segment of an insertion needle of the other one of the inserted connection members is provided, in the axial direction, with a connecting hole in cooperation with the connecting portion.

19. A train connector, comprising the inserted connection member according to claim 5, wherein a number of the inserted connection member is two, and an inserted connection segment of an insertion needle of one of the inserted connection members extends outwards in an axial direction to form a connecting portion, and an inserted connection segment of an insertion needle of the other one of the inserted connection members is provided, in the axial direction, with a connecting hole in cooperation with the connecting portion.

* * * * *